US005601157A

United States Patent [19]

Barth

[11] Patent Number: 5,601,157

[45] Date of Patent: Feb. 11, 1997

[54] DECKLOCK

[75] Inventor: Gene M. Barth, West Bend, Wis.

[73] Assignee: Pflow Industries, Milwaukee, Wis.

[21] Appl. No.: 423,368

[22] Filed: Apr. 18, 1995

[51] Int. Cl.[6] ..... B66B 5/16

[52] U.S. Cl. ..... 187/351; 187/360

[58] Field of Search ..... 187/351, 356, 187/357, 359, 360, 207, 302; 414/545

[56] References Cited

U.S. PATENT DOCUMENTS

| | | | |
|---|---|---|---|
| 2,772,753 | 12/1956 | Nordgard | 187/360 |
| 2,856,028 | 10/1958 | Racely | 187/360 |
| 5,228,537 | 7/1993 | Pfleger et al. | 187/253 |
| 5,263,808 | 11/1993 | Kent | 414/545 |

FOREIGN PATENT DOCUMENTS

| | | | |
|---|---|---|---|
| 0578238 | 1/1994 | European Pat. Off. | 187/360 |
| 0855690 | 12/1960 | United Kingdom | 187/357 |

*Primary Examiner*—James W. Keenan
*Attorney, Agent, or Firm*—Andrus, Sceales, Starke & Sawall

[57] ABSTRACT

A vertical reciprocating conveyor having an improved safety mechanism for automatically locking the conveyor at an elevated level. The conveyor comprises a cargo-supporting carriage which is guided for movement between a lower level and an upper level on a supporting structure. A drive mechanism which can take the form of a hydraulic cylinder is operably connected to the carriage and moves the carriage from the lower to the upper level. A locking arrangement having a pair of ramp members and a locking projection is mounted on the supporting structure at the upper level and is movable among a release position, an extended position and a locking position. An actuating assembly including a roller depending from the pivot arm and a catch plate is mounted for movement on the carriage for moving the locking arrangement between the release position and the locking position. As the carriage moves upwardly from its lower level to a third level slightly above the upper level, the roller traverses between the ramp members to move the locking arrangement from the release position to the extended position and then to the locking position and the carriage engages a limit switch which acts to discontinue operation of the hydraulic system enabling the carriage to lower by gravity to the upper level. At the third level, the roller moves downwardly over one of the ramp members until the catch plate on the actuating assembly engages the locking projection on the locking arrangement to thereby lock the carriage to the supporting structure at the upper level.

20 Claims, 3 Drawing Sheets

FIG. 4
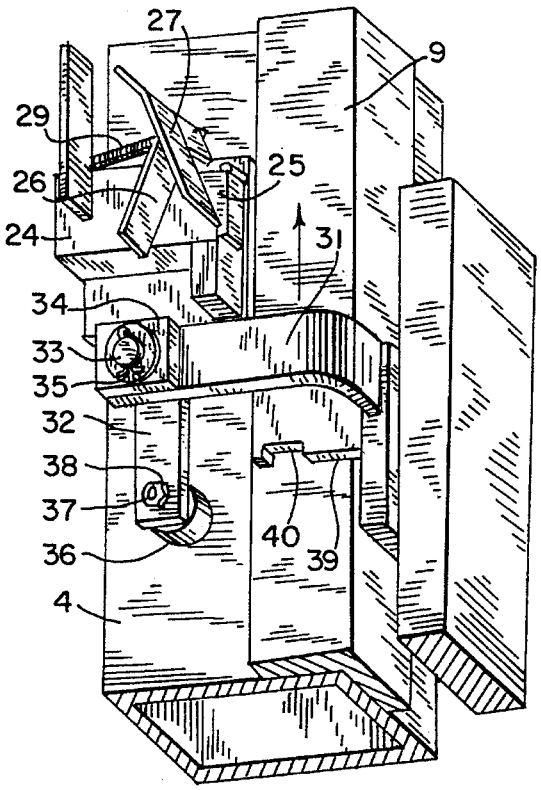
FIG. 5
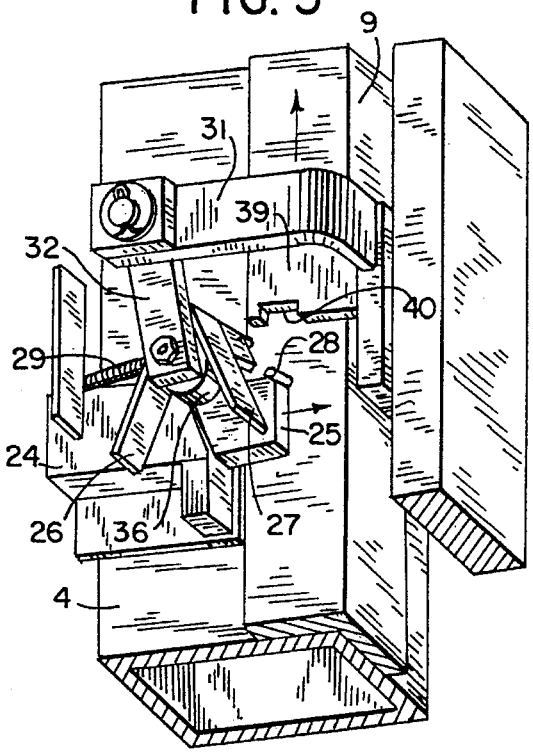
FIG. 6
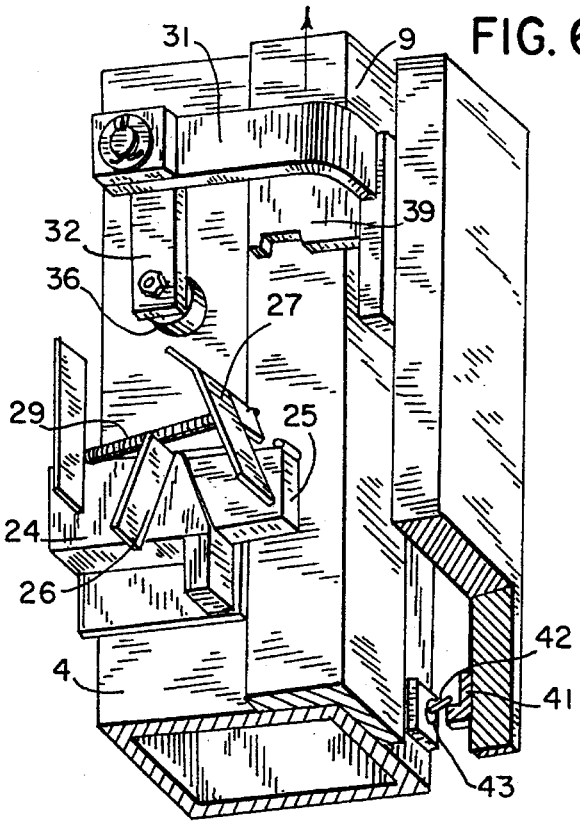
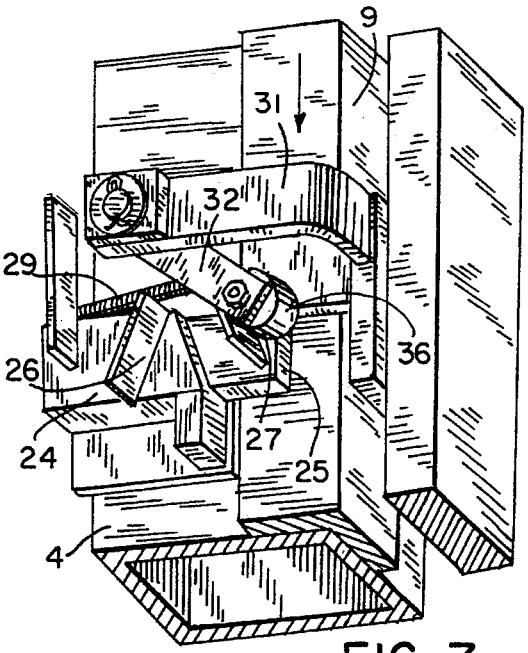
FIG. 7

FIG. 8
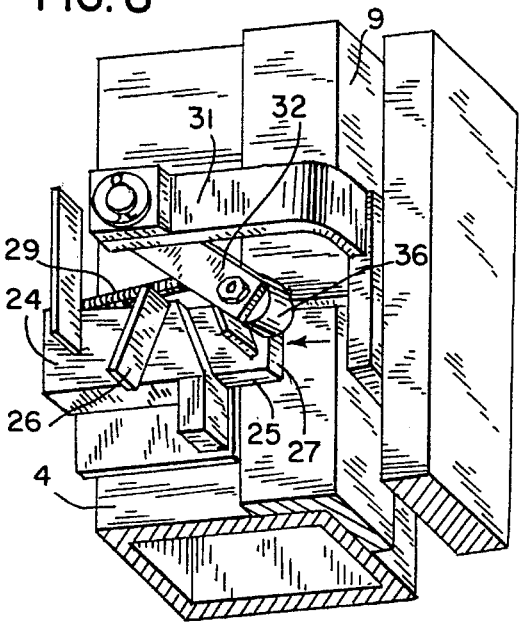
FIG. 9
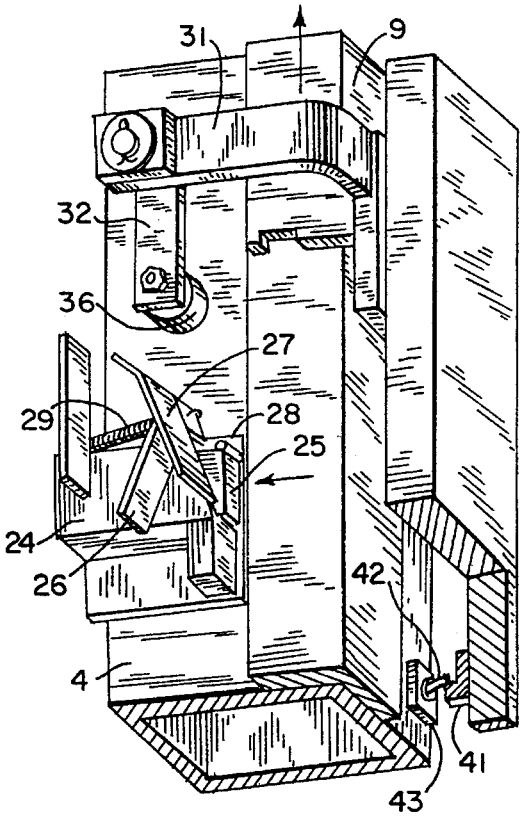
FIG. 8(a)
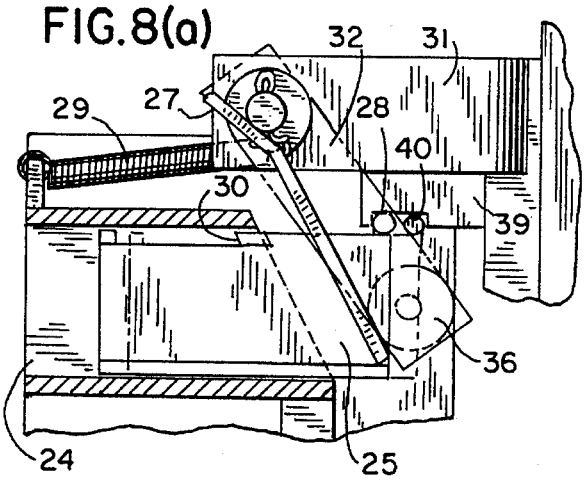
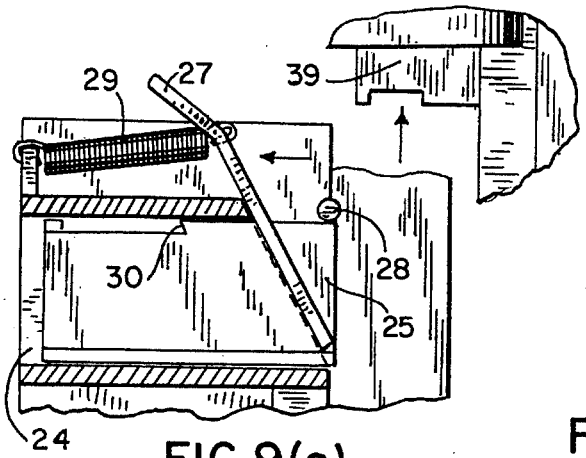
FIG. 9(a)
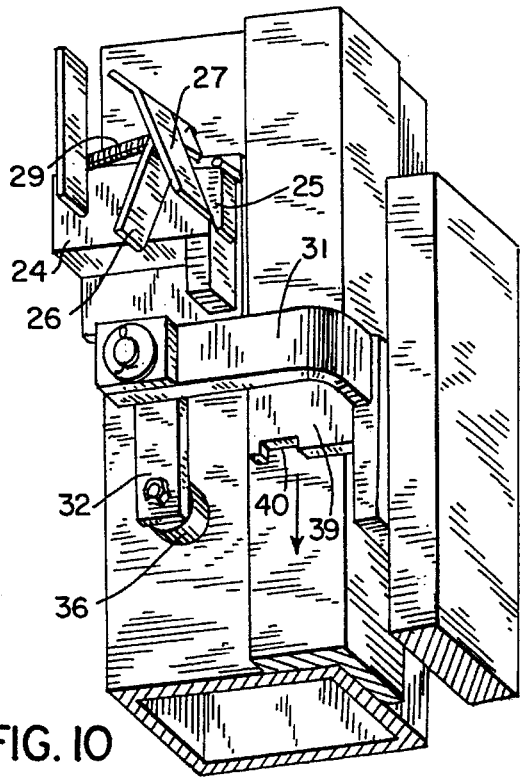
FIG. 10

DECKLOCK

FIELD OF THE INVENTION

The invention relates to a vertical reciprocating conveyor employed to move cargo between two or more different vertical levels.

BACKGROUND OF THE INVENTION

The typical vertical conveyor includes a carriage having a platform to support the cargo and the carriage is guided for vertical movement between the lower and upper levels on a supporting structure or frame that includes a pair of spaced vertical columns. With a hydraulically actuated conveyor, one or more hydraulic cylinder units are each connected through a cable or chain mechanism to the carriage and through extension of the cylinder units, the carriage can be raised to the upper level. To lower the carriage, operation of the pump motor of the hydraulic system is terminated and valving is actuated to permit discharge of the hydraulic fluid from the cylinder units and consequent controlled lowering of the carriage.

A typical mechanically operated vertical conveyor utilizes an electric motor that is connected through a chain drive to the carriage. Operation of the reversible motor will act to raise and lower the carriage. As a safety feature, the typical vertical conveyor includes an overload protection mechanism which will sense an overload on the carriage as the carriage is elevated and terminate operation of the drive system.

The conventional vertical conveyor has been dependent solely on the lift mechanism to support the carriage at the upper level. Because of the natural elasticity of either the cable or chain, which connects the drive unit to the carriage, and due to the flexing of the hydraulic hoses in a hydraulically operated conveyor, the conveyor has been found to move as much as an inch and one-half as it is loaded or unloaded at the upper level. To deal with this problem, many hydraulically operated vertical conveyors have incorporated a pressure switch to stop operation of the hydraulic pump motor when the carriage is at its upper level. The pressure switch builds pressure within the hydraulic system, thereby significantly reducing the stretch of the lifting cables or chains and the flexing of the hydraulic hose. However, the pressure which is built up through use of the pressure switch bleeds off in a relatively short period of time, either because of oil leaking past the hydraulic cylinder seals or the oil leaking through the check valve, so that after the pressure is bled off, the floating condition will reappear. As a result, unintentional descent of the carriage from an upper level can occur, creating a severe safety hazard.

In an effort to address this problem, U.S. Pat. No. 5,228,537, issued Jul. 20, 1993 to Pfleger et al and assigned to the assignee of this application, discloses a safety mechanism for automatically locking a vertical conveyor at an elevated or upper level to thereby prevent uncontrolled descent of the carriage. The conveyor comprises a carriage having a platform adapted to support a load of cargo, and the carriage is guided for vertical movement on a supporting structure frame and includes a pair of spaced vertical columns. The carriage is moved between the upper and lower levels by a drive mechanism which preferably consists of one or more hydraulic cylinders which are mounted on the supporting frame and which are connected through a cable and sheave arrangement to the carriage.

The safety mechanism of the aforementioned patent includes a pair of locking bars that are mounted on the opposite sides of the carriage and are adapted to engage ledges or abutments on the vertical columns of the supporting frame when the carriage is at an upper, elevated level. As the carriage moves upwardly, it passes slightly past the upper level to a higher position and actuates a limit switch on the supporting frame. Actuation of the limit switch terminates operation of the pump motor of the hydraulic system and actuates the valving to permit the hydraulic cylinders to lower the carriage. At the higher position, the locking bars are moved from a retracted or release position to a locking position so the locking bars can engage abutments on the vertical columns as the carriage moves downwardly from the third higher position to the upper level.

To move the carriage from the upper level or second level back down to the lower level, the cylinder units are actuated, causing the carriage to move upwardly from the second level to the third higher position and again actuate the limit switch to terminate operation of the pump motor, thus enabling the carriage to lower. Simultaneously, the locking bars are moved from the locking position to the release position, so the carriage can then descend through the upper level back to the lower level.

More particularly, the locking bars are pivotally connected to opposite sides of the carriage and are biased outwardly to the locking position where they can engage the abutments on the respective columns of the supporting frame. When the carriage is at the lower level, a follower on each locking bar is engaged with a projection or holding member on a slide that is movable relative to the carriage, and the engagement of the follower with the projection holds the locking bar in the release or retracted position.

When the carriage is elevated slightly above the upper level to the third position, the slide and the carriage engages a stop which moves the slide downwardly relative to the locking bar, thereby moving the projection out of engagement with the follower and permitting the locking bar to pivot outwardly to the locking position under the influence of the biasing mechanism. As the carriage then lowers from the third position to the upper level, the locking bars will engage the abutments on the column to hold the carriage at the upper level.

While the above-described arrangement has generally been satisfactory, problems sometimes arise in the user's installation of the safety mechanism which causes the locking bars to malfunction. In particular, depending on the installed location of the stop mounted on each vertical column of the supporting frame, the locking bars are susceptible to remain in a retracted position relative to the abutments so that the locking function may be inconsistent which resurrects a safety hazard.

In an effort to rectify this complication, it would be extremely desirable to provide an improved safety mechanism which eliminates the use of the installed stop in order to improve the operation of the vertical conveyor. Likewise, it would be desirable to simplify the multi-component locking arrangement used in the prior art. At the same time, the safety mechanism should continue to provide an overload protection mechanism for sensing an overload on the carriage as the carriage is elevated to discontinue operation of the drive mechanism. Furthermore, the improved safety mechanism should stabilize the carriage against lateral shifting relative to the supporting frame and prevent downward float to the carriage as a load or cargo is applied to the carriage.

SUMMARY OF THE INVENTION

The invention advantageously provides an improved safety mechanism, or decklock, for automatically locking a vertical conveyor at an elevated or upper level to thereby prevent uncontrolled descent of the carriage.

In one aspect of the invention, a vertical conveyor comprises a supporting structure, and a carriage adapted to support cargo and movable relative to the supporting structure from a first lower level to a second upper level. A drive arrangement moves the carriage between the lower level and the upper level and a locking arrangement is mounted on the support structure and is movable between a locking position and a release position. A biasing arrangement biases the locking arrangement to the release position and a mechanism is provided for discontinuing operation of the drive arrangement when the carriage is moved to the third level above the upper level to enable the carriage to move downwardly from the third level. An actuating assembly is movably mounted on the carriage for moving the locking arrangement between the locking position and the release position. The locking arrangement comprises a locking guide body fixedly mounted on the supporting structure and a locking member slidably mounted with respect to the locking guide body. The locking member has a projection and the actuating assembly includes a catch plate engageable with the projection in the locking position.

In another aspect of the invention, a vertical conveyor comprises a supporting structure and a carriage adapted to support cargo and movable relative to the supporting structure from the first lower level to a second upper level. A drive arrangement moves the carriage between the upper level and the lower level and a locking arrangement is mounted on the support structure at the second upper level and is movable between a locking position and a release position. An actuating assembly is mounted for movement with the carriage among a first position beneath and disengaged from the locking arrangement, a second position engageable with the locking arrangement for moving the locking arrangement to the locking position, a third position above and disengaged from the locking arrangement, a fourth position engageable with the locking arrangement and the locking position, a fifth position above and disengaged from the locking arrangement for moving the locking arrangement to the release position and a sixth position beneath and disengaged from the locking arrangement for allowing the carriage to descend from the third level to the second level to the lower level.

The locking arrangement includes a pair of ramp members and a locking projection while the actuating assembly includes a roller depending from a pivot arm as well as the catch plate. As the carriage moves upwardly from its lower level to a third level slightly above the upper level, the roller traverses between the ramp members to move the locking arrangement from the release position and the carriage engages a limit switch which acts to discontinue operation of a hydraulic system enabling the carriage to lower by gravity to the upper level. At the third level, the roller moves downwardly over one of the ramp members until the catch plate on the actuating assembly engages the locking projection on the locking arrangement to thereby lock the carriage to the supporting structure at the upper level. To move the carriage from the upper level back to the lower level, the cylinder unit is actuated causing the carriage to move upwardly from the upper level to the third level, during which the roller then moves upwardly on the one ramp member and the catch plate disengages from the projection which causes the locking arrangement to move to the release position. At the third level, the limit switch is actuated to terminate the operation of a hydraulic system, enabling the roller to move downwardly over the one ramp member as the carriage moves downwardly through the upper level back to the lower level.

BRIEF DESCRIPTION OF THE DRAWINGS

The invention will become better understood by reference to the following detailed description of the preferred exemplary embodiment when read in conjunction with the appended drawing, wherein like numerals denote like elements and:

FIG. 4 is an enlarged fragmentary perspective view of the improved safety mechanism with the carriage being shown at a position beneath the upper level;

FIG. 5 is a view similar to FIG. 4 showing the carriage slightly above the upper level with the locking arrangement engaged with the actuating assembly;

FIG. 6 is a view similar to FIG. 5 showing the carriage at a third level with the locking arrangement disengaged from the actuating assembly;

FIG. 7 is a view similar to FIG. 6 showing the carriage lowering onto the locking arrangement;

FIG. 8 is a view similar to FIG. 7 showing the carriage locked to the supporting frame in the locking position;

FIG. 8(*a*) is an elevational view of FIG. 8;

FIG. 9 is a view similar to FIG. 8 showing the carriage raised to the third position and the locking arrangement in its release position;

FIG. 9(*a*) is an elevational view of FIG. 9; and

FIG. 10 is a view similar to FIG. 9 showing the carriage being lowered to its lower level.

DESCRIPTION OF THE PREFERRED EXEMPLARY EMBODIMENT

Figure 1:
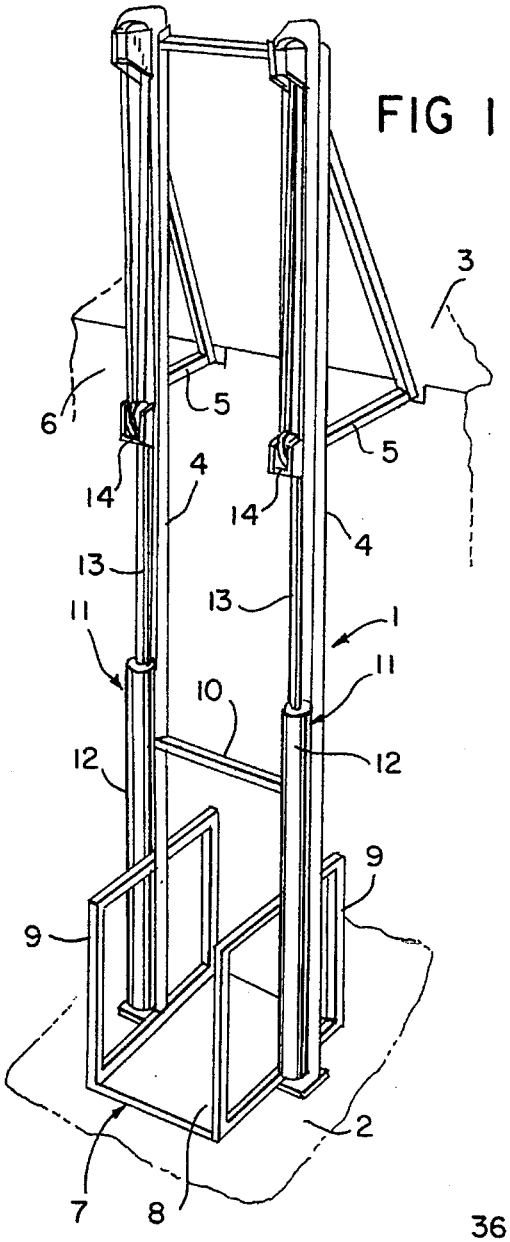
FIG. 1 is a perspective view of a vertical reciprocating conveyor incorporating the improved safety mechanism of the invention.

FIG. 1 shows a vertical reciprocating conveyor 1 which is adapted to convey cargo between a lower level 2 and an upper level 3 of a building.

Conveyor 1 includes a supporting frame that consists of a pair of spaced vertical columns 4. The upper ends of columns 4 can be stabilized by braces 5 that connect the columns with the wall 6 of the building.

A carriage 7 is adapted to move vertically relative to columns 4 between the lower level 2 and upper level 3. Carriage 7 includes a generally flat platform 8 that is adapted to support the load or cargo and side frames 9 extend upwardly from opposite sides of platform 8. The upper ends of the side frames 9 are connected by a cross brace 10. In practice, protective gates, not shown, are mounted on the open sides of the carriage.

Figure 2:
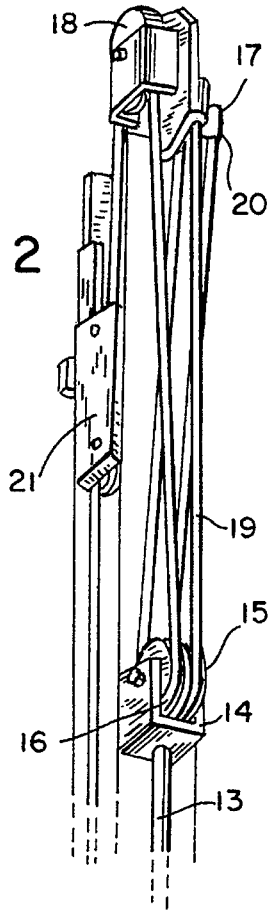
FIG. 2 is an enlarged perspective view of the cable and sheave arrangement.

Carriage 7 is moved between the lower level 2 and the upper level 3 by a drive mechanism which, as illustrated, comprises a pair of hydraulic cylinder units 11. Each unit 11 includes a cylinder 12 which is connected to a column 4 and a piston rod 13 is slidable in each cylinder 12. The piston rods 13 of cylinders 12 are connected to opposite sides of frame 9 of carriage 7 through a cable and sheave arrangement. As seen in FIG. 2, a double clevis 14 is mounted on the upper end of each piston rod 13 and a pair of sheaves 15 and 16 are mounted for rotation on clevis 14. In addition, a pair of sheaves 17 and 18 are mounted on the upper end of each column 4. One end of a cable 19 is dead-ended on the column 4, as indicated by 20, and the cable then passes downwardly around sheave 15, upwardly around sheave 17, downwardly around sheave 16, upwardly around sheave 18, and is attached to a wheel block 21 mounted on side frame 9 of carriage 7. Each wheel block 21 includes a series of rollers, not shown, which are adapted to ride on the inner surface of column 4 to guide the carriage 7 in vertical movement.

As a salient feature of the invention, an approved safety mechanism is associated with each side frame 9 of carriage 7 and is adapted to lock the carriage 7 at the upper level 3 and prevent uncontrolled descent of the carriage in case of an overload. Each safety mechanism comprises a locking arrangement 22 mounted at the upper level 3 on column 4 of the stationary supporting frame and an actuating assembly 23 mounted on side frame 9 of moveable carriage 7.

Figure 3:
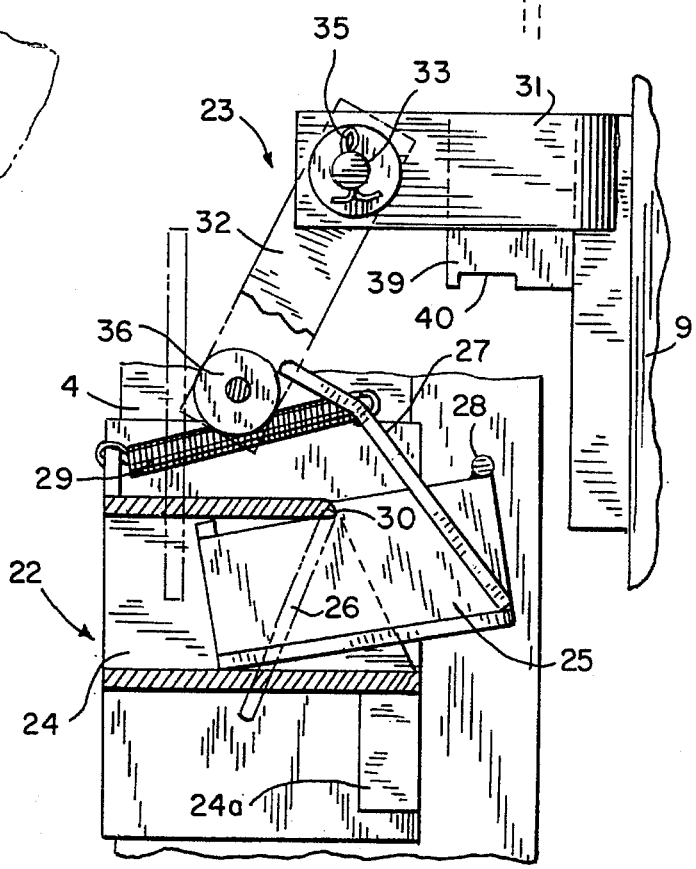
FIG. 3 is an enlarged fragmentary elevational view of the locking arrangement in an extended position.

Each locking arrangement 22 includes a locking guide body 24 having a depending leg 24*a* fixedly mounted on column 4 of supporting frame and a locking member 25 slidably mounted for movement into and out of locking guide body 24 between a locking position depicted in FIG. 8, an extended position seen in FIG. 6, and the release position shown in FIGS. 1, 9 and 10. Fixed to locking guide member 24 is a first ramp member 26 inclined forwardly with respect to side frame 9. Joined to locking member 25 is a second ramp member 27 inclined rearwardly with respect to side frame 9. A round projection 28 is provided on the upper nose of locking member 25 and serves to provide a locking surface as will be appreciated hereafter. A spring 29 extends between the top portion of locking guide body 24 and an upper portion of second ramp member 27 and is biased to retain locking member 25 in a retracted or release position. As seen in FIG. 3, locking member 25 is undercut with a notched portion 30, typically cut at a 60° angle, which interacts with locking guide body 24 to hold locking member 25 against spring 29 when locking arrangement 22 approaches a locking position.

Each actuating assembly 23 includes a curved bracket 31, one end of which is fixed to carriage 7 and another end of which carries a pivot arm 32. The upper or proximal end of pivot arm 32 is mounted for pivotal movement on a headed shaft 33 which passes through a reinforcement plate 34 on bracket 31 and is retained against axial movement by a cotter pin retainer 35. Lower or distal end of pivot arm 32 is provided with a roller 36 which is rotatably secured on the shaft of a headed bolt 37 having a nut 38 threaded thereon. A catch plate 39 depends from the curved portion of bracket 31 and is formed with an indentation 40 on its underside which is engageable with locking projection 28 during the locking function.

OPERATION

To move carriage 7 upwardly from lower level 2, as shown in FIG. 4, cylinder units 11 are actuated causing retraction of piston rods 13 and corresponding upward movement of carriage 7. The system is designed so that carriage 7 will move upwardly to a third level slightly higher than the upper level 3 and, at this level, a projection or abutment 41 on carriage 7 will engage the arm of 42 of a limit switch 43. Actuation of limit switch 43 will discontinue operation of the pump motor and the hydraulic system and also actuate the valving to permit flow of hydraulic fluid from the upper end of cylinder. The weight of the carriage 7 will then cause extension of piston rods 13 to lower carriage 7 from the third level to upper level 3, at which locking arrangement 22 is positioned. Bracket 31 passes to the outside of ramp members 26 and 27 and roller 36 traverses upwardly engaging both ramp member 26 and 27. This causes locking member 25 to slide outwardly from locking guide body 24 against the bias of spring 29 to an extended position attained by the notched portion 30 on locking member 25 canting slightly upward and hitching on the inclined, upper portion of locking guide body 24 as shown in FIG. 3. As the actuating assembly 23 reaches the third level, shown in FIG. 6, abutment 41 on carriage 7 engages the arm 42 of limit switch 43. Actuation of limit switch 43 will discontinue operation of the pump motor and the hydraulic and also cause valving to permit flow from the upper end of the cylinder. The weight of carriage 7 will cause extension of piston rods to lower carriage 7 and actuating assembly 23 from the third level to the upper level 3. As illustrated in FIG. 7, roller 36 moves in a downward path over ramp member 27 and the weight of catch plate 39 causes locking member 25 to move into locking guide body 24 from the extended position to the locking position shown in FIGS. 8 and 8(*a*) at which indentation 40 on catch plate 39 positively engages projection 28 on locking member 25 to complete the locking function of carriage 7 to supporting frame. It should be appreciated that during this motion, the notched portion 30 of locking member 25 becomes disengaged from locking guide body 24 but it is not retracted fully by spring 29 due to the engagement of catch plate 39 with projection 28.

When it is desired to return carriage 7 to its lower level 2, cylinder units 11 are again actuated causing carriage 7 to rise to the third level slightly above upper level 3. As the carriage 7 moves upwardly, catch plate 39 disengages from projection 28 and roller 36 traverses upwardly over ramp member 27 after which locking member 25 is free to return via spring 29 to its release position shown in FIG. 9. Upon carriage 7 reaching the third level, limit switch 43 will again be actuated to terminate operation of the pump motor to enable carriage 7 to lower from upper level 3 to lower level 2 such that roller 36 rides downwardly over ramp member 27 and bracket 31 passes to the outside of locking arrangement 22 as shown in FIG. 10.

The invention can also incorporate a standard overload protection mechanism in the hydraulic system, which will sense an overload condition on the carriage, as the carriage is elevated, to discontinue operation of the pump motor. As the carriage 7, when at the upper level 3, must initially go "up" before it can go "down" to the lower level 2, the overload protection mechanism will sense an overload as the carriage is moved upwardly from the upper level and thereby discontinue operation of the drive and prevent locking arrangement 22 from moving to the retracted position. Therefore, if the carriage is subjected to an overload condition at the upper level, the invention will automatically retain the overloaded carriage at the upper level and prevent uncontrolled descent.

The engagement of the locking arrangement 22 with the actuating assembly 23 also aids in stabilizing the carriage 7 against lateral shifting as cargo is loaded or unloaded from the carriage 7 at the upper level. In addition, engagement of the locking arrangement 22 with the actuating assembly 23 will prevent downward float to the carriage as cargo is applied to the carriage platform at the upper level 3.

Unlike the prior art, the fixed stop on the column 4 is eliminated and the locking arrangement is markedly simplified, to ensure positive, safety locking of the carriage without uncontrolled descent thereof.

While the drawings show a hydraulic drive mechanism, it is contemplated that other drive mechanisms can also be used, such as an electric or hydraulic motor operating through a chain drive. Similarly, the mechanism can also be incorporated with vertical conveyors that move to two or more levels.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with the following claims.

I claim:

1. A vertical conveyor comprising a supporting structure, a carriage adapted to support cargo and moveable relative to said supporting structure from a first lower level to a second upper level and a third level above said upper level, drive means for moving said carriage among said lower, said upper and said third levels, locking means mounted on said supporting structure and disposed to interconnect said carriage and supporting structure and moveable among a release position, an extended position, and a locking position, biasing means continuously urging said locking means towards said release position, actuating means for moving said locking means from said release position to said extended position as said carriage moves from said lower level to said third level, said locking means in said extended position being out of contact with said carriage and prevented against return to said release position as urged by said biasing means, said actuating means moving said locking means from said extended position to said locking position as said carriage moves from said third level to said upper level; the subsequent movement of said carriage from said upper level to said third level enabling said locking means to return to said release position by means of said biasing means, operation of said drive means being discontinued at said third level to allow said carriage to move to said lower level.

2. The conveyor of claim 1, wherein said locking means comprises a locking guide body fixedly mounted on said supporting structure and a locking member slidably mounted in said locking guide body, said locking member having a projection, said actuating means includes a catch plate disposed to be engageable with said projection when said locking means is in said locking position.

3. The conveyor of claim 1, and including means for discontinuing operation of said drive means when said carriage is moved to said third level.

4. The conveyor of claim 1, wherein said drive means comprises a hydraulic cylinder unit having a retracted condition and an extended condition, said carriage being at said lower level when said cylinder unit is in an extended condition and said carriage being at said third level when said cylinder unit is in the retracted condition.

5. A vertical conveyor comprising a supporting structure, a carriage adapted to support cargo and moveable relative to said supporting structure from a first lower level to a second upper level, drive means for moving said carriage between said lower and upper levels, locking means to interconnect said carriage and said supporting structure and moveable between a locking position and a release position, biasing means for urging said locking means towards said release position, actuating means for moving said locking means to said locking position when said carriage is at said upper level, said locking means comprising ramp means engageable with said actuating means for moving said locking means between said locking position and said release position, wherein said locking means further comprises a locking guide body fixed on said supporting structure and a locking member slidably mounted into the locking guide body, said ramp means comprises a first ramp member fixedly secured to said locking guide body and a second ramp member fixedly secured to said locking member, said actuating means includes a roller engageable with said first ramp member and said second ramp member to move said locking member between said locking position and said release position.

6. The conveyor of claim 5, wherein said actuating means further includes a bracket secured to said carriage, a catch plate mounted on said bracket, a pivot arm having a proximal end pivotally secured to said bracket and a distal end rotatably secured to said roller.

7. A vertical conveyor comprising a supporting structure, a carriage adapted to support cargo and moveable relative to said supporting structure from a first lower level to a second upper level and a third level above said upper level, drive means for moving said carriage among said upper level, said third level and said lower level, locking means mounted on said support structure at said second upper level for interconnecting said support structure with said carriage and moveable among an extended position, a locking position and a release position, said locking means in said extended position being out of contact with said carriage, biasing means for continuously urging said locking means toward said release position, actuating means mounted for movement on said carriage among a first position beneath and disengaged from said locking means, a second position engageable with said locking means for moving said locking means towards said extended position, a third position above and disengaged from said locking means, a fourth position engageable with said locking means in said locking position, a fifth position above and disengaged from said locking means for moving said locking means to said release position and a sixth position beneath and disengaged from said locking means for allowing said carriage to descend from said third level to said second level to said lower level.

8. The conveyor of claim 7, wherein said third position and said fifth position are located at said third level.

9. The conveyor claim 7, wherein said second position and said fourth position are located at said upper level.

10. The conveyor of claim 7 including roller means on said actuating means and ramp means on said locking means, said roller means engageable with said ramp means to move said locking means from said release position to said locking position.

11. The conveyor of claim 10, wherein said ramp means includes a first ramp member mounted on said locking means and a second ramp member mounted on said locking means, said roller means engageable with both said first ramp member and said second ramp member to place said actuating means in said second position.

12. The conveyor of claim 11, wherein said roller means is engageable over a downward path with said second ramp member to place said actuating means in said fourth position.

13. The conveyor of claim 11, wherein said roller means is engageable over an upward path with said second ramp member to place said actuating means in said fifth position.

14. The conveyor of claim 11, wherein said roller means is engageable over a downward path with said second ramp member to place said actuating means in said sixth position.

15. The conveyor of claim 7 including overload sensing means for sensing an overload on said carriage when said carriage is moved upwardly and operable to discontinue operation of said drive means.

16. The conveyor of claim 7, wherein said drive means comprises a hydraulic system including a cylinder unit.

17. The conveyor of claim 16 and including overload sensing means for sensing a predetermined increase in pressure in the hydraulic system when said carriage is moved upwardly with a predetermined overload, said overload sensing means constructed and arranged to discontinue operation of said hydraulic cylinder.

18. A vertical conveyor comprising a supporting structure, a carriage adapted to support cargo and moveable relative to said supporting structure from a first lower level to a second upper level, drive means for moving said carriage between said lower level and said upper level, locking means mounted on said support structure and moveable among an extended position, a locking position and a release position, biasing means for continuously urging said locking means to said release position, means for discontinuing operation of said drive means when said carriage is moved to a third level above said upper level to enable said carriage to move downwardly from said third level, actuating means movably mounted on said carriage for moving said locking means between said locking position and said release position, said locking means comprising a locking guide body fixedly mounted on said supporting structure and a locking member slidably mounted with respect to said locking guide body, said locking member being tiltable on said locking guide body when said locking means is in said extended position, said locking member having a projection, said actuating means including a catch plate engageable with said projection in said locking position.

19. The conveyor of claim 18, wherein said locking member includes notch means engageable with a portion of said locking guide body for preventing movement of said locking means in said extended position.

20. A vertical conveyor comprising a supporting structure, a carriage adapted to support cargo and moveable relative to said supporting structure from a first lower level to a second upper level, drive means for moving said carriage between said upper level and said lower level, locking means mounted on said support structure at said second upper level and moveable among an extended position, a locking position and a release position, actuating means mounted for movement on said carriage among a first position beneath and disengaged from said locking means, a second position engageable with said locking means for moving said locking means towards said extended position, a third position above and disengaged from said locking means, a fourth position engageable with said locking means in said locking position, a fifth position above and disengaged from said locking means for moving said locking means to said release position and a sixth position beneath and disengaged from said locking means for allowing said carriage to descend from said third level to said second level to said lower level, said actuating means including roller means and said locking means including ramp means, said roller means engageable with said ramp means to move said locking means from said release position to said locking position, said ramp means includes a first ramp member mounted on said locking means and a second ramp member mounted on said locking means, said roller means engageable with both said first ramp member and said second ramp member to place said actuating means in said second position.

* * * * *